US009687857B2

(12) United States Patent
Berthod et al.

(10) Patent No.: US 9,687,857 B2
(45) Date of Patent: Jun. 27, 2017

(54) DEVICE AND METHOD FOR RECOVERING MAGNETIC PARTICLES TRAPPED ON A MAGNETIC PLUG

(75) Inventors: Gilles Berthod, Massy (FR); Fabrice Colladon, Dammarie-les-Lys (FR)

(73) Assignee: SNECMA, Paris (FR)

( * ) Notice: Subject to any disclaimer, the term of this patent is extended or adjusted under 35 U.S.C. 154(b) by 663 days.

(21) Appl. No.: 13/637,160

(22) PCT Filed: Mar. 21, 2011

(86) PCT No.: PCT/FR2011/050577

§ 371 (c)(1),
(2), (4) Date: Oct. 25, 2012

(87) PCT Pub. No.: WO2011/121207

PCT Pub. Date: Oct. 6, 2011

(65) Prior Publication Data

US 2013/0037470 A1 Feb. 14, 2013

(30) Foreign Application Priority Data

Mar. 29, 2010 (FR) ..... 10 52291

(51) Int. Cl.
*B03C 1/28* (2006.01)
*B03C 1/032* (2006.01)

(52) U.S. Cl.
CPC ..... *B03C 1/032* (2013.01); *B03C 1/286* (2013.01); *B03C 2201/18* (2013.01); *B03C 2201/28* (2013.01)

(58) Field of Classification Search
CPC ..... B03C 1/286; B03C 1/284; B03C 1/28; B03C 1/0332; B03C 2201/28;
(Continued)

(56) References Cited

U.S. PATENT DOCUMENTS 2,693,979 A 11/1954 Russell
5,027,966 A * 7/1991 Yadock ..... B01L 9/06 220/230

(Continued)

FOREIGN PATENT DOCUMENTS

| | | |
|---|---|---|
| FR | 2 848 128 | 6/2004 |
| GB | 855928 | 12/1960 |
| WO | WO 87/05536 | 9/1987 |

OTHER PUBLICATIONS

International Search Report as issued for PCT/FR2011/050577.

*Primary Examiner* — David C Mellon
(74) *Attorney, Agent, or Firm* — Pillsbury Winthrop Shaw Pittman LLP

(57) ABSTRACT

A device for recovering magnetic particles trapped on a magnetic plug that has a bar magnet to retain the magnetic particles entrained by a liquid in which the magnetic plug is immersed, the device including a cap including a non-magnetic tube having a proximal end having an opening for the insertion of the magnet into the tube and a closed distal end, the tube to cover the magnet when it is inserted into the tube, a retention device to ensure retention between the cap and the magnet when the magnet is inserted into the tube, an extraction device provided with an opening to ensure insertion of the tube into the extraction device, the extraction device to cover the tube when the tube is inserted into the extraction device and to receive the particles trapped on the tube when the magnet is withdrawn from the tube, and a retention device to ensure retention between the extraction device and the tube.

16 Claims, 3 Drawing Sheets

(58) Field of Classification Search
CPC ..... B03C 2201/20; B03C 2201/18; H01F 7/0221; B01L 3/50825
USPC ..... 210/222; 335/303, 305
See application file for complete search history.

(56) References Cited

U.S. PATENT DOCUMENTS

| | | | | |
|---|---|---|---|---|
| 5,043,063 | A | 8/1991 | Latimer | |
| 2002/0088756 | A1 | 7/2002 | Wolosion | |
| 2003/0183580 | A1 | 10/2003 | Schaaf et al. | |
| 2007/0262028 | A1* | 11/2007 | Flaherty | 210/695 |

* cited by examiner

DEVICE AND METHOD FOR RECOVERING MAGNETIC PARTICLES TRAPPED ON A MAGNETIC PLUG

CROSS REFERENCE TO RELATED APPLICATIONS

This application is the U.S. National Stage of PCT/FR2011/050577, filed Mar. 21, 2011, which in turn claims priority to French Patent Application No. 1052291, filed Mar. 29, 2010, the contents of all applications are incorporated herein by reference in their entireties.

The invention relates to a device and to a method for recovering magnetic particles trapped on a magnetic plug for retaining, by means of a magnet, magnetic particles entrained by a liquid and resulting from wear of parts such as rotating parts disposed in a casing for equipment or for an aircraft engine, for example.

It is known to place a magnetic plug in a circuit of moving liquid (typically oil, coolant liquid or fuel) inside a casing containing moving parts such as gears or bearings, which are bathed in said liquid.

In general, the function of the liquid circuit is to lubricate and/or cool moving parts (typically rotating parts). It so happens that moving parts undergo wear over their lifetime, for example because of friction resulting from contact between two toothed wheels or bearings, or due to intense friction or shock between rotating parts due to intense, abnormal vibrations being propagated in the casing. Irrespective of the cause, wear to parts results in the formation of particles that become detached from the parts and are entrained by the liquid in the liquid circuit. Because the rotating parts are generally metallic, the particles resulting from wear of the parts are conductive and are generally in the form of filings. Moreover, the parts are usually produced from a ferromagnetic type metal such as iron, i.e. capable of being attracted by a magnetic element such as a magnet. The magnetic plug is typically used as a complement to a conventional filter, placed downstream of the plug, which will filter out non-magnetic particles. Filters and plugs are positioned so that they are easy to maintain.

In known manner and as illustrated diagrammatically in FIG. 1, a magnetic plug 1 comprises a head or support 2 at one end and a permanent magnet formed by a bar magnet 3 immersed in the liquid circuit, said bar 3 attracting metallic particles 20 as the liquid circulates.

During on-the-ground maintenance operations, on-site operators then have to check periodically for the presence of particles on these magnetic plugs, remove the particles trapped on the bar magnet and have them analyzed, for example using scanning electron microscope (SEM) and energy dispersion spectroscopy (EDS) type analyses. From those analyses, it is possible to identify the nature and geometry of the removed particles. Depending on the position of the plug in the circuit, it is then possible to locate the element or elements affected by wear and take measures that will guarantee the integrity of the machine and in-flight safety. Various techniques are known that operators can employ to remove the particles trapped on the magnetic plug.

A first technique consists of using an adhesive tape that the operator brings into contact with the bar magnet of the plug. Such a solution is not entirely satisfactory, since the particles remain stuck on the adhesive and are difficult to detach (by dissolving the adhesive tape) for analysis. Thus, a residue of particles remains that cannot be used for analysis, resulting in a loss of information. Further, the adhesive could generate surface pollution of the particles that might falsify the results of the material analysis.

A second technique consists of using a cloth to remove the particles on the bar magnet. Such a solution also poses certain problems. It is necessary to clean the cloth by immersing it in a solvent, then filtering the product obtained in order to recover the particles. Further, using a cloth makes it difficult to recover all of the particles; consequently, not all of the particles are available for analysis and a residue of particles remains on the bar magnet; this residue could falsify the indication of pollution during subsequent inspection. Finally, using a cloth that might potentially be polluted could run the risk of introducing pollution from outside.

A third technique may consist of direct removal of the particles on the bar using a magnet that is more powerful than the magnet of the bar magnet. However, such a solution is difficult to put into practice as it runs the risk of altering the magnetic plug by modifying its remanent field.

Thus, the particular aim of the invention is to overcome the disadvantages cited above. In this context, the present invention aims to provide a device that can be used for simple (including the context of in-situ recovery, for example on an aircraft wing), rapid, reliable and complete recovery of magnetic particles trapped on a magnetic plug.

To this end, the invention pertains to a device for recovering magnetic particles trapped on a magnetic plug, said magnetic plug comprising a bar magnet for retaining magnetic particle entrained by a liquid in which said magnetic plug is immersed, said device being characterized in that it comprises:

- a cap comprising an amagnetic tube comprising:
  - a proximal end provided with an opening that allows the bar magnet to be introduced into said tube;
  - a closed distal end, said tube being capable of overlaying the bar magnet when the bar magnet is introduced into said tube;
- means for ensuring retention between said cap and the bar magnet when the bar magnet is introduced into said tube;
- extraction means provided with an opening for allowing said tube to be introduced into said extraction means, said extraction means being capable of overlaying said tube when said tube is introduced into said extraction means so as to form a sealed extraction chamber and of receiving particles trapped on said tube when the bar magnet is withdrawn from said tube, said device being suitable for sending away in order to carry out analysis of the particles;
- means for ensuring retention between said extraction means and said tube when said tube is introduced into said extraction means.

The invention allows the operator to detach magnetic particles from the magnetic plug without losing any of said particles. In addition, the invention allows the particles to be transported safely to the location where they will be analyzed with a minimum of handling, thereby minimizing the risk of alteration to or contamination of the particles.

In addition to the principal characteristics mentioned in the preceding paragraph, the device of the invention may exhibit one or more of the following supplemental characteristics, whether considered individually or in any technically possible combinations:

- said means for ensuring retention between said extraction means and said tube when said tube is introduced into said chamber are reversible connection means;
- said reversible connection means are formed by a screw-nut system placed at said proximal end of said tube;

said cap comprises a collar connected to the proximal end of said tube and provided with a thread on its external diameter;

said tube is an elastic sheath that can enclose the bar magnet;

said tube comprises a ferromagnetic element placed at its distal end;

said means for ensuring retention between said cap and the bar magnet when the bar magnet is introduced into said tube comprise sealing means that can prevent the insertion of metallic particles between the tube and the bar magnet;

said means for ensuring retention between said cap and the bar magnet when the bar magnet is introduced into said tube comprise an O-ring inserted in said cap that clamps the bar magnet by elasticity;

said means for ensuring retention between said cap and the bar magnet when the bar magnet is introduced into said tube comprise flexible tongues inserted in the cap that clamp the bar magnet by elasticity;

said means for ensuring retention between said cap and the bar magnet when the bar magnet is introduced into said tube comprise flexible tabs inserted in the cap that clamp the bar magnet by elasticity;

said magnetic plug comprises a support end and said proximal end is capable of coming into contact with the support end when the bar magnet is introduced into said tube.

The present invention also provides a method for recovering magnetic particles trapped on a magnetic plug using a device in accordance with the invention, said method comprising the following steps:

placing the cap on the bar magnet of the magnetic plug by introducing the bar magnet into the tube;

placing the magnetic plug provided with the cap in position and operating the engine;

extracting the magnetic plug from the engine;

fixing the extraction means on the cap;

extracting the device by withdrawing the bar magnet from the tube.

Other characteristics and advantages of the invention will become apparent from the following description, made by way of non-limiting indication and with reference to the accompanying figures in which.

For the purposes of clarity, only those elements that are useful in understanding the invention have been shown, and these are not to scale and are shown in a diagrammatic manner. Further, similar elements located on different figures have identical reference numerals.

Figure 1:
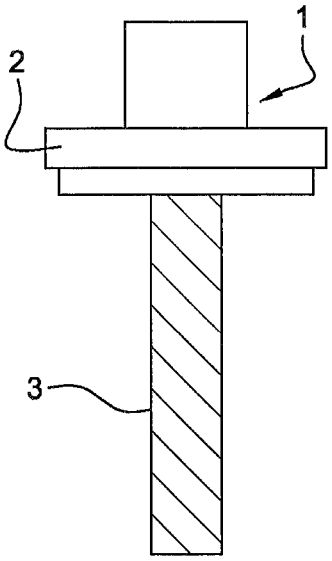
Prior Art Fig. 1
FIG. 1 is a diagrammatic representation of a magnetic plug.

FIG. 1 has already been described with reference to the prior art.

Figure 2:
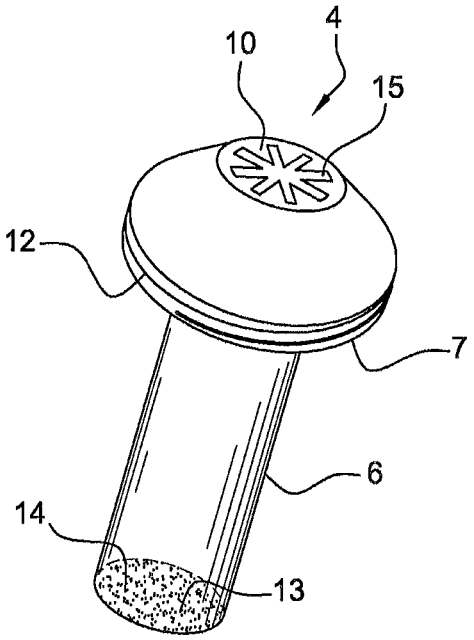
FIG. 2 is a diagrammatic representation of the cap.

FIG. 2 is a diagrammatic representation of a cap 4 that is one of the elements of the device 100.

The cap 4 of the invention comprises a tube 6 comprising an open proximal end 15 and a closed distal end 14. In order to ensure retention between the cap 4 and the bar magnet 3 as shown in FIG. 1, the tube 6 comprises a connecting device 10 between the cap 4 and the bar magnet 3 when the bar magnet 3 is introduced into the tube 6. The connecting device 10 can also act as a seal between the cap 4 and the bar magnet 3.

Figure 7:
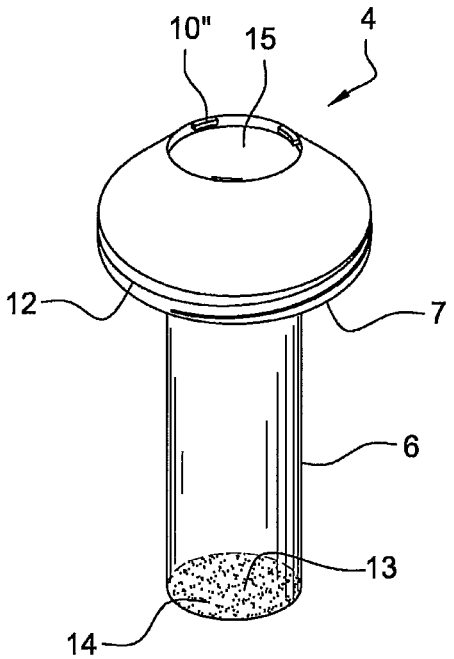
FIGS. 7 and 8 are diagrammatic representations of two other embodiments of the cap.
Figure 8:
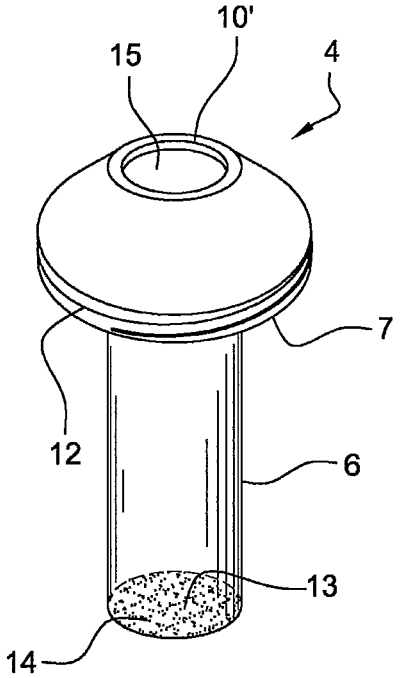

The shape and dimensions of the tube 6 match the shape and dimensions of the bar magnet 3 such that the tube 6 can overlay the bar magnet 3 as closely as possible. The tube 6 may be formed from a flexible or rigid plastics material, or from a metal. So that it does not perturb the magnetic field of the bar magnet 3, the tube 6 must be amagnetic. The tube 6 may be formed by a flexible elastic sheath that can enclose the bar magnet 3 and ensure that the cap 4 is retained on it. The elastic sheath must be resistant to the environment in which the magnetic plug is immersed. The device 10 providing the connection and the seal between the cap 4 and the bar magnet 3 in this case is formed by flexible tongues 10; this device may also be an O-ring 10' as shown in FIG. 8, or tabs 10" formed from rubber, as shown in FIG. 7, inserted into the tube 6 at its proximal end 15 (the other elements in FIGS. 7 and 8 are identical to the elements of FIG. 2).

Figure 4:
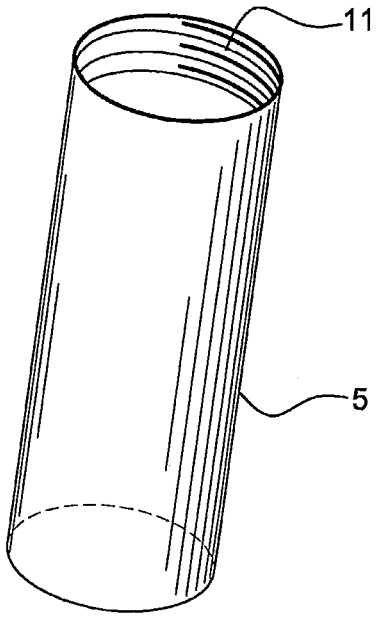
FIG. 4 is a diagrammatic representation of the extractor.

The cap 4 also comprises a collar 7, which is annular in shape, extending outwardly of the tube and connected to the proximal end 15 of the tube 6 and supporting means 12 for reversible connection with the extractor 5 as shown in FIG. 4, to which we shall revert below.

The device for connection of the tube 6 with the bar 3 may be a ferromagnetic element 13 placed at the distal end 14 of the tube 6 which, once the tube 6 is in contact on the magnetic bar 3, is attracted by said bar magnet 3 and can provide retention between the tube 6 and the bar magnet 3. This ferromagnetic element 13 may supplement or replace the device 10 for connection between the tube 6 and the bar magnet 3 as described above, but cannot provide a seal between the tube 6 and the bar magnet 3.

Figure 5:
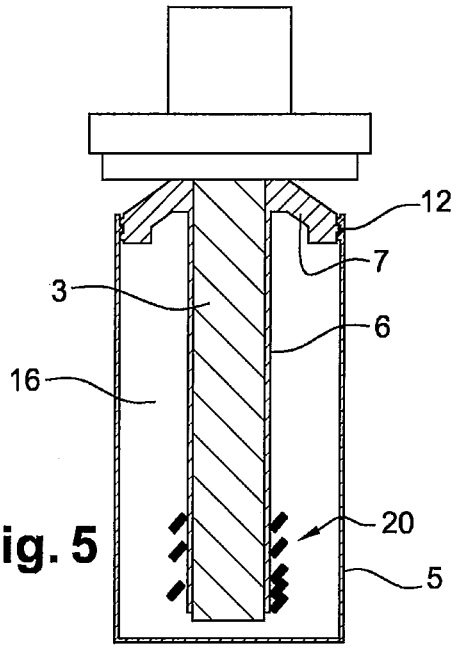
FIG. 5 is a diagrammatic representation of the device mounted on the magnetic plug.

The extractor 5 shown in FIG. 4 is a tube comprising a proximal end and a closed distal end which will cover the tube 6 and the collar 7 so as to form a sealed extraction chamber 16 as shown in FIG. 5. The extractor 5 may be formed from a plastics material or from metal, but it must be amagnetic. Advantageously, the extractor 5 may include a labeling zone in order to facilitate identification thereof.

The means 12 for reversible connection between the extractor 5 and the cap 4 are, for example, formed by a thread 12 on the external diameter of the collar 7 and a thread 11 located on the extractor 5 which cooperate to form a screw-nut system. Other connection devices, not shown, may be used: push fitting, snap fitting, tabs, etc. The connection between the extractor 5 and the cap 4 must have a solidity sufficient to allow the device 100 to be removed from the bar magnet 3 and to ensure that the particles contained in the sealed extraction chamber 16 do not escape from it.

Figure 6:
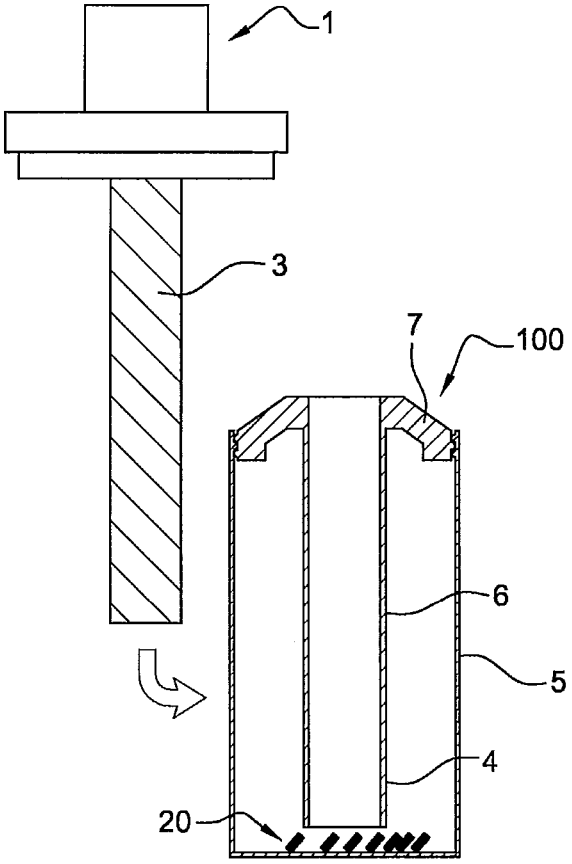
FIG. 6 is a diagrammatic representation of extraction of the device from the magnetic plug.

FIG. 6 illustrates removal of the device 100 from the magnetic plug 1 and the device 100 alone.

We shall now describe, with reference to FIGS. 1 to 6, an example of a method for recovering ferromagnetic particles trapped on a magnetic plug 1 as shown in FIG. 1 using a recovery device 100 in accordance with the invention as shown in FIG. 6. This recovery device 100 integrates the cap 4 and the extractor 5. This method will preferably be carried out on site by an operator during a machine inspection operation.

Figure 3:
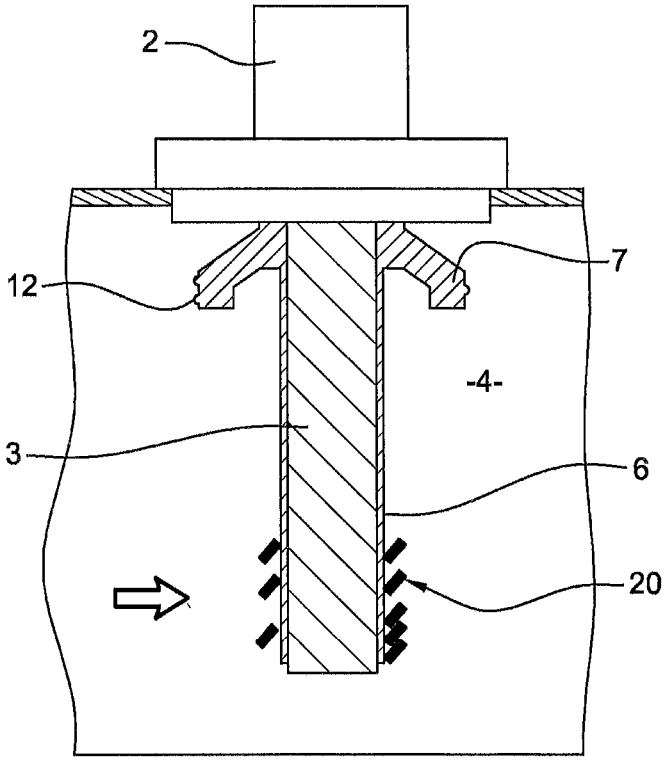
FIG. 3 is a diagrammatic representation of the magnetic plug and its cap in a liquid circuit.

In the first step illustrated in FIGS. 1 and 2, after having been removed from the engine by the operator, the magnetic plug is covered by the cap 4 to produce the assembly illustrated in FIG. 3. More precisely, the cap 4 is disposed on the bar magnet 3 until the proximal end 15 of the tube 6 is in contact with the head 2 of the magnetic plug 1.

In the second step illustrated in FIG. 3, the plug 1 and the cap 4 are inserted into the engine and it is started up. The ferromagnetic particles 20 in suspension in the liquid are attracted by the bar magnet 3 and stick to the wall of the tube 6.

In the next step, the magnetic plug is withdrawn from the engine by the operator.

The next step, illustrated in FIGS. 4 and 5, will consist of attaching the extractor 5 to the cap 4 by screwing (via threads 11 and 12) in order to trap the particles 20 in the extraction chamber 16.

In the last step illustrated in FIG. 6, the operator withdraws the device 100 containing the particles from the magnetic plug 1 so that the particles 20 fall to the bottom of the extractor 5 since they are no longer retained by the bar magnet 3. The device 100 can then be sent away for analysis of the particles.

The invention means that handling the particles can be avoided and thus prevents them from being lost or contaminated. Further, the device 100 can be re-used once the particles have been analyzed.

Clearly, the invention is not limited to the embodiment that has just been described.

The device of the invention that has just been described is of particularly advantageous application when used with magnetic plugs used for any machine where it is important to be able to detect wear, in particular on turbine aero engines. In these latter, using a plurality of magnetic plugs on different oil circuits means that a part that is starting to wear can rapidly be located.

The invention claimed is:

1. A device for recovering magnetic particles trapped on a magnetic plug, said magnetic plug comprising a bar magnet for retaining magnetic particles entrained by a liquid in which said magnetic plug is immersed, said device comprising:

a cap comprising a non-magnetic tube, said non-magnetic tube comprising:

a proximal end provided with an opening that allows the bar magnet to be introduced into said non-magnetic tube;

a closed distal end, said non-magnetic tube being capable of overlaying the bar magnet when the bar magnet is introduced into said non-magnetic tube;

a first retention device to ensure retention between said cap and the bar magnet when the bar magnet is introduced into said non-magnetic tube;

an extraction device provided with an opening for allowing said non-magnetic tube to be introduced into said extraction device, said extraction device being capable of overlaying said non-magnetic tube when said non-magnetic tube is introduced into said extraction device so as to form a sealed extraction chamber, the magnetic particles being introduced into the extraction device only through the opening, and being capable of receiving particles trapped on said non-magnetic tube when the bar magnet is withdrawn from said non-magnetic tube;

a second retention device to ensure retention between said extraction device and said non-magnetic tube when said non-magnetic tube is introduced into said extraction device, wherein the extraction device includes a single opening defined by said opening for allowing said non-magnetic tube to be introduced into said extraction device, wherein the extraction device has a shape of an elongated tube, and wherein the non-magnetic tube has an outer longitudinal wall extending along a longitudinal direction of the non-magnetic tube between the proximal end and the closed distal end, the elongated tube has an inner longitudinal wall extending along a longitudinal direction of the elongated tube, and the outer longitudinal wall is spaced apart from the inner longitudinal wall when the non-magnetic tube is introduced into the elongated tube so as to collect the particles trapped on the outer longitudinal wall in the sealed extraction chamber.

2. The device as claimed in claim 1, wherein said second retention device to ensure retention between said extraction device and said non-magnetic tube when said non-magnetic tube is introduced into said extraction device is a reversible connector.

3. The device as claimed in claim 2, wherein the reversible connector is formed by a screw-nut system placed at said proximal end of said non-magnetic tube.

4. The device as claimed in claim 1, wherein said cap comprises a collar connected to the proximal end of said non-magnetic tube and provided with a thread on an external diameter of the collar.

5. The device as claimed in claim 1, wherein said non-magnetic tube is an elastic sheath that is configured to enclose the bar magnet.

6. The device as claimed in claim 1, wherein said non-magnetic tube comprises a ferromagnetic element placed at a distal end of the non-magnetic tube.

7. The device as claimed in claim 1, wherein said first retention device to ensure retention between said cap and the bar magnet when the bar magnet is introduced into said non-magnetic tube comprises a seal that is adapted to prevent the insertion of metallic particles between the non-magnetic tube and the bar magnet.

8. The device as claimed in claim 1, wherein said first retention device to ensure retention between said cap and the bar magnet when the bar magnet is introduced into said non-magnetic tube comprises an O-ring inserted in said cap that clamps the bar magnet by elasticity.

9. The device as claimed in claim 1, wherein said first retention device to ensure retention between said cap and the bar magnet when the bar magnet is introduced into said non-magnetic tube comprises flexible tongues inserted in the cap that clamp the bar magnet by elasticity.

10. The device as claimed in claim 1, wherein said first retention device to ensure retention between said cap and the bar magnet when the bar magnet is introduced into said non-magnetic tube comprises flexible tabs inserted in the cap that clamp the bar magnet by elasticity.

11. The device as claimed in claim 1, wherein said magnetic plug comprises a support end, and said proximal end of the non-magnetic tube is capable of coming into contact with the support end when the bar magnet is introduced into said non-magnetic tube.

12. The device as claimed in claim 1, wherein the elongated tube is a cylinder.

13. The device as claimed in claim 1, wherein the second retention device includes threads to fasten the non-magnetic tube to the extraction device.

14. The device as claimed in claim 1, wherein said sealed extraction chamber is configured to surround at least part of said bar magnet when said bar magnet is introduced into said non-magnetic tube and said non-magnetic tube, provided with said bar magnet, is introduced into the extraction chamber.

15. A device for recovering magnetic particles trapped on a magnetic plug, said magnetic plug comprising a bar magnet configured to retain magnetic particles entrained by a liquid in which said magnetic plug is to be immersed, said device comprising:

a cap comprising a non-magnetic tube, said non-magnetic tube comprising:

a proximal end provided with an opening that allows the bar magnet to be introduced into said non-magnetic tube;

a closed distal end, said non-magnetic tube being capable of overlaying the bar magnet when the bar magnet is introduced into said non-magnetic tube;

a retainer configured to hold said cap and the bar magnet together when the bar magnet is introduced into said non-magnetic tube;

an extraction device provided with an opening and configured to allow said non-magnetic tube to be introduced into said extraction device, said extraction device being capable of overlaying said non-magnetic tube when said non-magnetic tube is introduced into said extraction device so as to form a sealed extraction chamber, the magnetic particles being introduced into the extraction device only through the opening, and being capable of receiving particles trapped on said non-magnetic tube when the bar magnet is withdrawn from said non-magnetic tube;

a connector configured to hold said extraction device and said non-magnetic tube together when said non-magnetic tube is introduced into said extraction device, wherein the non-magnetic tube has an outer longitudinal wall extending along a longitudinal direction of the non-magnetic tube between the proximal end and the closed distal end, the extraction device has a shape of an elongated tube, the elongated tube has an inner longitudinal wall extending along a longitudinal direction of the elongated tube, and the outer longitudinal wall is spaced apart from the inner longitudinal wall when the non-magnetic tube is introduced into the elongated tube so as to collect the particles trapped on the outer longitudinal wall in the sealed extraction chamber.

16. A method for recovering magnetic particles trapped on a magnetic plug using a device for recovering magnetic particles, said magnetic plug comprising a bar magnet for retaining magnetic particles entrained by a liquid in which said magnetic plug is immersed, said device comprising:

a cap comprising a non-magnetic tube, said non-magnetic tube comprising:

a proximal end provided with an opening that allows the bar magnet to be introduced into said non-magnetic tube;

a closed distal end, said non-magnetic tube being capable of overlaying the bar magnet when the bar magnet is introduced into said non-magnetic tube;

a first retention device to ensure retention between said cap and the bar magnet when the bar magnet is introduced into said non-magnetic tube;

an extraction device provided with an opening for allowing said non-magnetic tube to be introduced into said extraction device said extraction device being capable of overlaying said non-magnetic tube when said non-magnetic tube is introduced into said extraction device so as to form a sealed extraction chamber, the magnetic particles being introduced into the extraction device only through the opening, and being capable of receiving particles trapped on said non-magnetic tube when the bar magnet is withdrawn from said non-magnetic tube;

a second retention device to ensure retention between said extraction device and said non-magnetic tube when said non-magnetic tube is introduced into said extraction device, wherein the extraction device includes a single opening defined by said opening for allowing said non-magnetic tube to be introduced into said extraction device, wherein the extraction device has a shape of an elongated tube, and wherein the non-magnetic tube has an outer longitudinal wall extending along a longitudinal direction of the non-magnetic tube between the proximal end and the closed distal end, the elongated tube has an inner longitudinal wall extending along a longitudinal direction of the elongated tube, and the outer longitudinal wall is spaced apart from the inner longitudinal wall when the non-magnetic tube is introduced into the elongated tube so as to collect the particles trapped on the outer longitudinal wall in the sealed extraction chamber, said method comprising:

placing the cap on the bar magnet of the magnetic plug by introducing the bar magnet into the non-magnetic tube;

placing the magnetic plug provided with the cap in position and operating the engine;

extracting the magnetic plug from the engine;

fixing the extraction device on the cap;

extracting the device by withdrawing the bar magnet from the non-magnetic tube.

* * * * *